US006477973B1

(12) United States Patent
Kobas

(10) Patent No.: US 6,477,973 B1
(45) Date of Patent: Nov. 12, 2002

(54) FENDER FOR WATERCRAFT

(75) Inventor: Joseph P. Kobas, Amsterdam, NY (US)

(73) Assignee: Taylor Made Products, Gloversville, NY (US)

( * ) Notice: Subject to any disclaimer, the term of this patent is extended or adjusted under 35 U.S.C. 154(b) by 0 days.

(21) Appl. No.: 09/922,806

(22) Filed: Aug. 7, 2001

(51) Int. Cl.[7] ..... B63B 59/02
(52) U.S. Cl. ..... 114/219
(58) Field of Search ..... 114/219, 220; D12/168; 405/212, 213, 214, 215; 293/102, 109, 120, 122, 125

(56) References Cited

U.S. PATENT DOCUMENTS

| | | | | | |
|---|---|---|---|---|---|
| 3,019,758 | A | * | 2/1962 | Erkert | 114/219 |
| 3,110,066 | A | * | 11/1963 | Ward et al. | 20/74 |
| 3,292,566 | A | * | 12/1966 | Russell | 114/219 |
| 3,950,953 | A | * | 4/1976 | Matthews | 61/48 |
| 4,136,632 | A | | 1/1979 | Day et al. | |
| 4,227,832 | A | * | 10/1980 | Leone et al. | 114/215 |
| 4,565,147 | A | * | 1/1986 | Bortolotti | 114/219 |
| 4,584,958 | A | * | 4/1986 | Green | 114/219 |
| 4,751,891 | A | * | 6/1988 | Wilson | 114/219 |
| 4,909,172 | A | * | 3/1990 | Hamby | 114/219 |
| 5,013,272 | A | * | 5/1991 | Watkins | 441/127 |
| 5,487,349 | A | | 1/1996 | Andreassen | |
| 5,560,312 | A | | 10/1996 | McPherson | |
| 5,671,692 | A | * | 9/1997 | Kimball | 114/219 |
| 5,740,752 | A | | 4/1998 | Allenbaugh | |
| 5,832,857 | A | | 11/1998 | McPherson | |
| 6,067,926 | A | | 5/2000 | Robinson | |
| 6,227,134 | B1 | | 5/2001 | Beckett | |

FOREIGN PATENT DOCUMENTS

| | | | | |
|---|---|---|---|---|
| EP | 319362 | * | 6/1989 | 114/219 |
| FR | 1497650 | * | 10/1967 | 114/219 |
| IT | 647886 | * | 10/1962 | 114/219 |
| JP | 55-031640 | * | 3/1980 | 114/219 |
| JP | 61-207287 | * | 9/1986 | 114/219 |
| SU | 494308 | | 12/1975 | |
| SU | 715384 | * | 2/1980 | 114/219 |

OTHER PUBLICATIONS

Pare–Battage et Defenses De Ponton; Accastillage Bernard Brochure; 2 pages; no date.
Parabordi Ad Incastro Jointing Fenders Defenses a Encastrement Einrastbare Fender; OCEAN Catalog; 4 pages; no date.

* cited by examiner

*Primary Examiner*—S. Joseph Morano
*Assistant Examiner*—Ajay Vasudeva
(74) *Attorney, Agent, or Firm*—Nixon & Vanderhye PC

(57) ABSTRACT

A fender is provided that is uniquely shaped to facilitate attachment to, for example, the transom of a boat and/or to a swimming platform. To conform to the shape of the edge to which the fender is applied, a cutout is defined along the length of the fender. The jaws that are defined by the cutout can flex open as tension is applied to the fender and securely grip and accommodate the shape of the associated structure.

15 Claims, 7 Drawing Sheets

FENDER FOR WATERCRAFT

BACKGROUND OF THE INVENTION

1. Field of the Invention

The present invention relates to a device for absorbing shocks from one object moving against another such as one boat and another boat, dock or pier and, more particularly, to a fender for preventing damage due to impact and friction.

2 Description of the Related Art

Fender structures are conventionally provided to protect boats as well as docks and piers from any damage that may be caused by an impact or relative rubbing movement therebetween. For example, it is well known to provide fenders in the form of elastomeric bodies hanging from ropes along the hull of the boat, between the boat and another boat or pier when the boat comes along side, to protect the hull from impact and wear. One conventional fender structure is a plastic air-filled cylinder that is suspended at the side of the boat so as to be vertically oriented.

Such fenders provide limited protection in the aft to stern direction and may roll relative to the watercraft so as to no longer be disposed between the boat and the associated pier or dock. Such fenders are also unsuitable, for example, for swimming platforms which, due to their proximity to the water cannot effectively be protected by a vertically oriented fender.

BRIEF SUMMARY OF THE INVENTION

It is an object of the present invention to provide a fender that can be mounted to virtually any edge of a watercraft or other structure to shield and protect the same from impact forces and damage due to rubbing adjacent structures, such as boats, piers or docks.

It is a further object of the invention to provide a fender that will remain in position along a designated edge of the watercraft or other structure.

It is a further object of the invention to provide a fender having an adjustable cushioning function.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
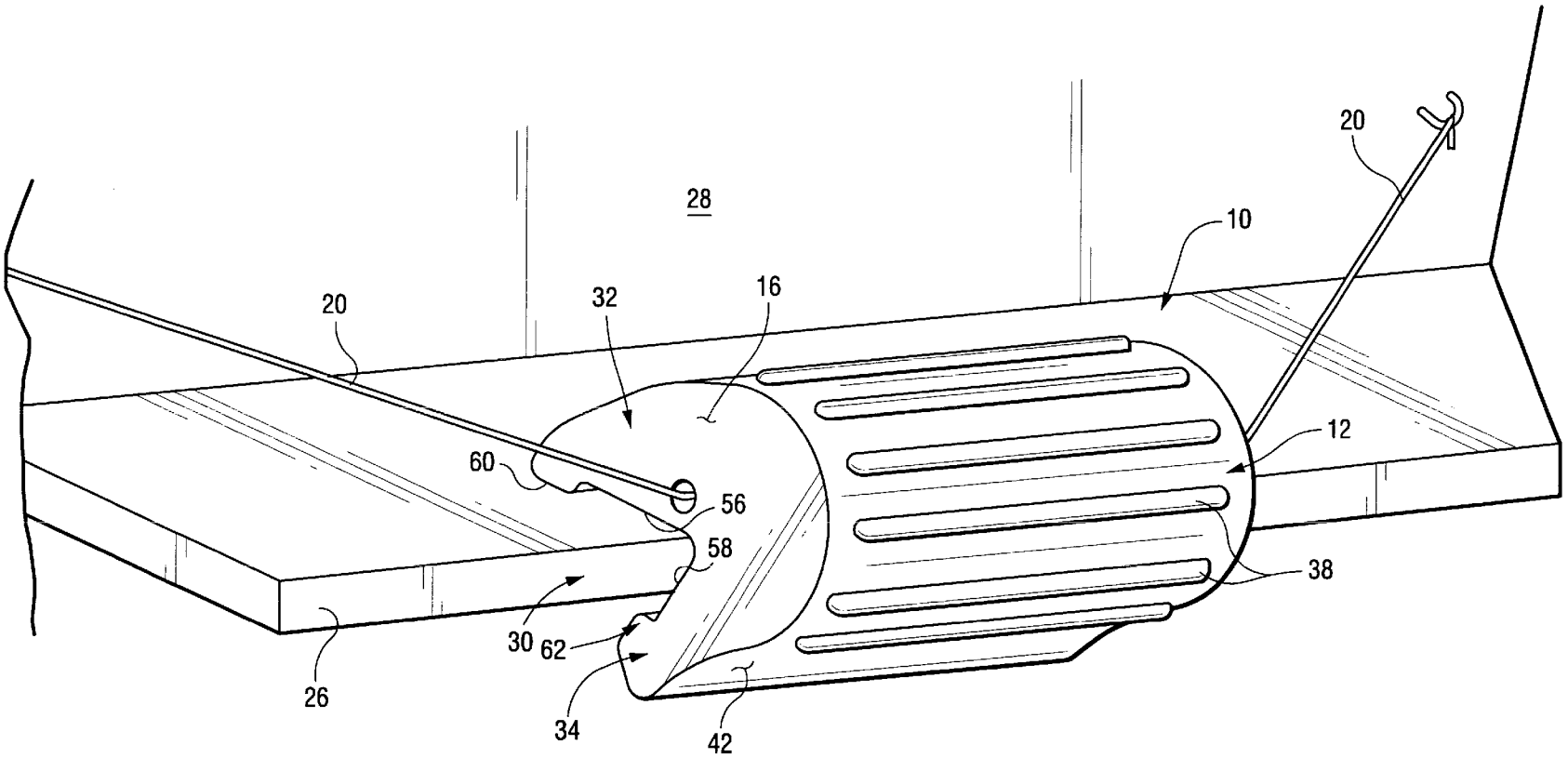
FIG. 1 is a perspective view of a fender embodying the invention secured to a swimming platform of a watercraft

In accordance with the present invention, a fender is provided that is uniquely shaped to facilitate attachment to a watercraft, particularly, for example, to the transom of a boat and/or to a swimming platform. To conform to the shape of the edge to which the fender is applied, a cutout section or groove is defined along the length of the fender. The jaws that are defined by the cutout can flex open as tension is applied to the fender and securely grip and accommodate the shape of the adjacent structure.

Thus, as an embodiment of the invention, a fender 10 is provided that includes a main body 12 having first and second generally planar ends 14,16 and a longitudinal axis extending therebetween. A bore 18 is defined longitudinally of the fender body for receiving a securing line 20 to fasten the fender to the watercraft. The bore 18 may be simply defined through the material of the fender or may be defined by a tube 22 that is integrated into the fender structure. In an exemplary embodiment, the bore 18 has a diameter of about ¾ to 1 inch to accommodate conventional securing lines.

Figure 2:
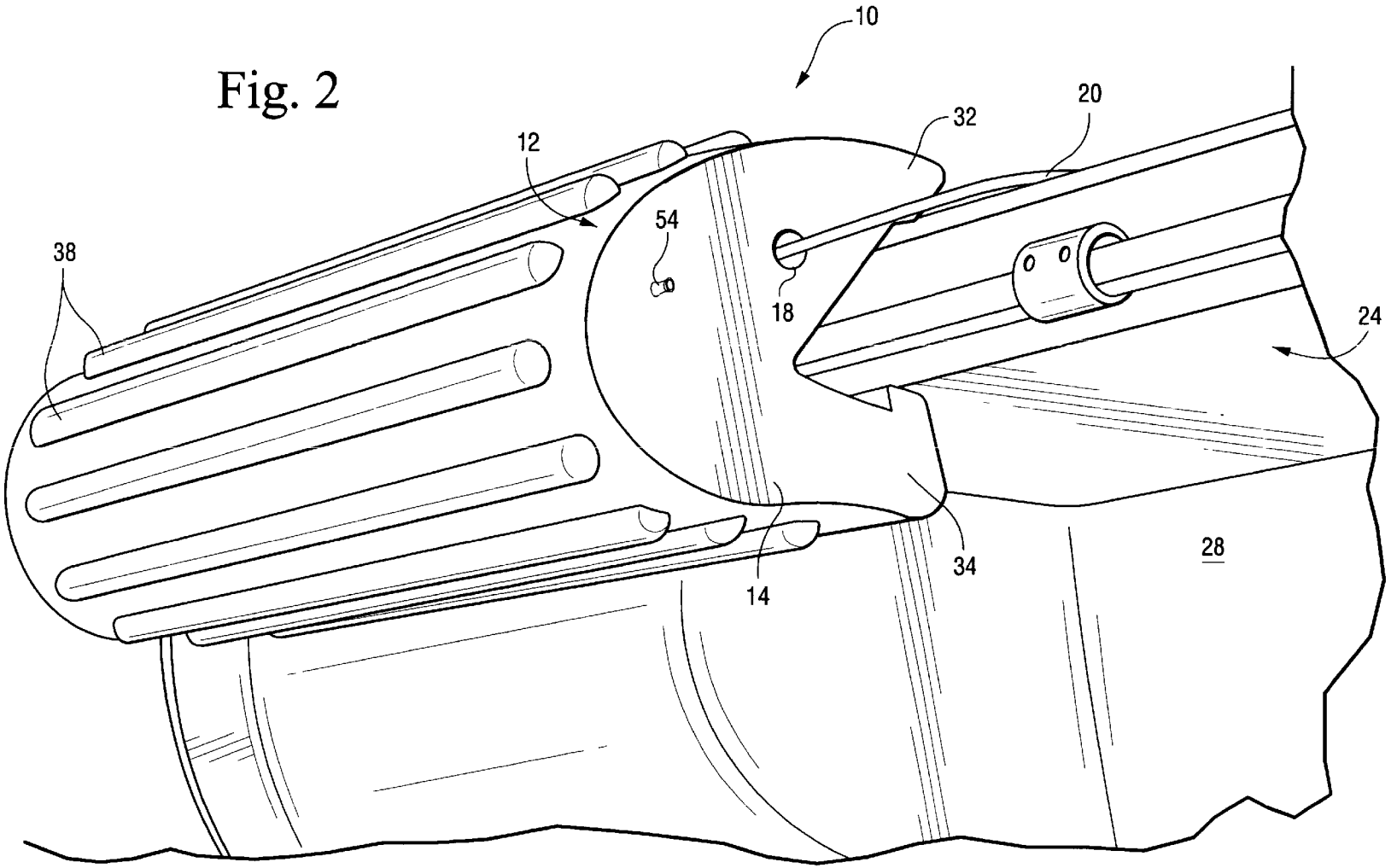
FIG. 2 is a schematic perspective view showing a fender embodying the invention secured to the transom of a watercraft.
Figure 3:
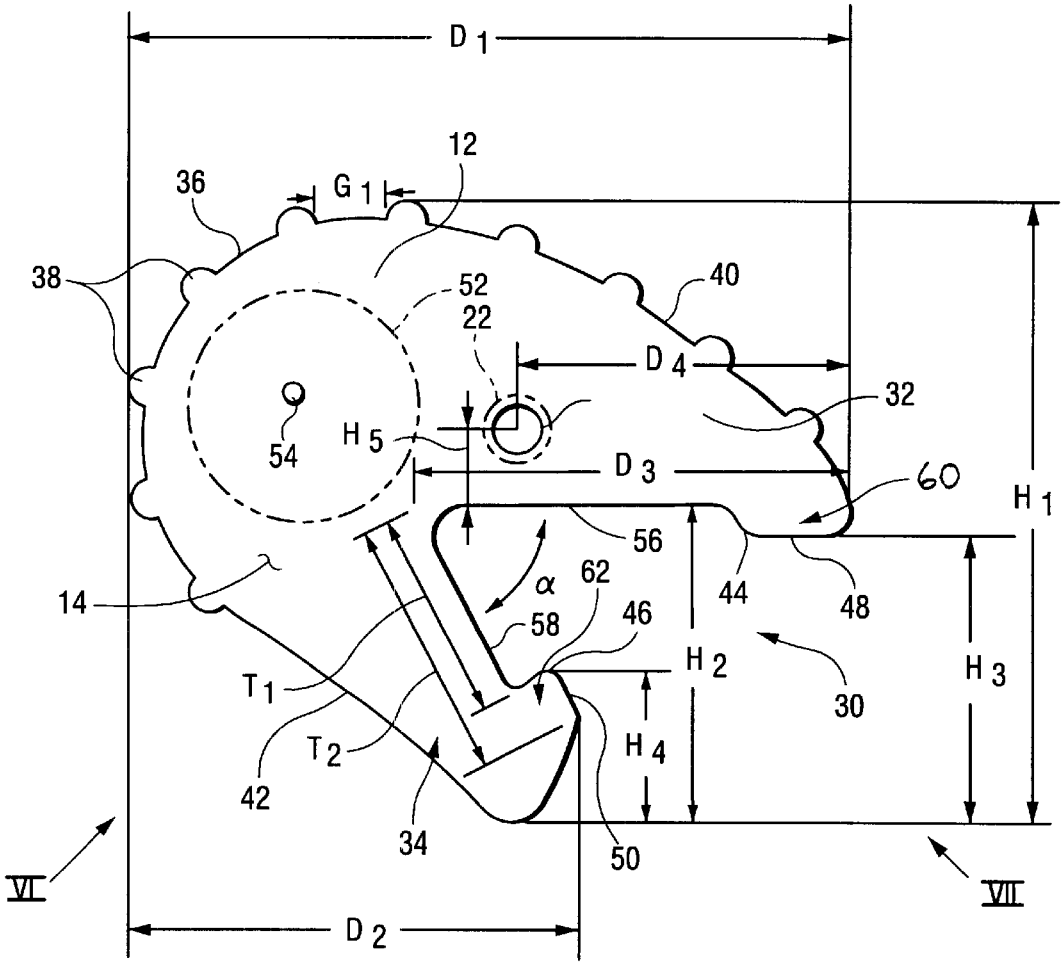
FIG. 3 is an end elevational view of a fender according to the invention.
Figure 4:
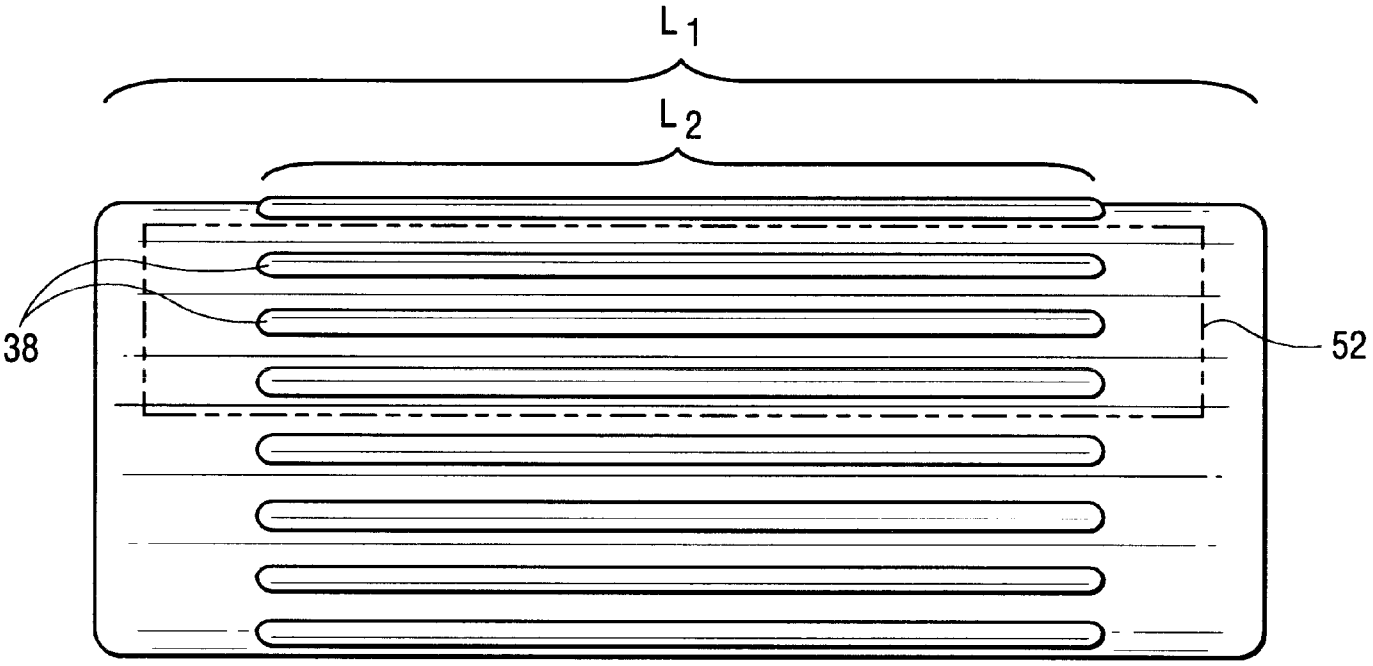
FIG. 4 is a top plan view of the fender of FIG. 3.

The fender is uniquely shaped to attach to the periphery of a watercraft, for example to the transom 24 and/or swimming platform 26 of a boat 28. To engage and accommodate the shape of the edge of the boat , a cutout or groove 30 is defined along the length of the fender. As a result, as illustrated in FIG. 3, the fender defines first and second jaws 32,34 for straddling the associated edge of the craft. The jaws extend from the main body 12, which provides the primary cushioning function of the fender structure. As can be seen in FIGS. 1 and 2, to properly dispose the main body 12 of the fender and to provide cushioning where needed, the cutout is asymmetrically defined to provide asymmetric upper and lower jaws, so that the first jaw 32, which is the upper jaw in the illustrated disposition, is somewhat thicker than the second or lower jaw 34. In some applications, however, it may be determined that a symmetrically disposed cutout to define symmetrical first and second jaws may be preferred and therefore the invention is not to be limited to the currently, most preferred, asymmetrical configuration shown.

The main body 12 of the fender is generally part cylindrical to define a continuously curved outer peripheral surface 36 for abutting engagement with adjacent structures. In the illustrated embodiment this peripheral surface includes a plurality of protrusions 38 to define a reduced slip surface for the boat user, while reducing frictional contact with adjacent structures. In the illustrated embodiment, the protrusions 38 are configured a elongated, generally semicircular ribs. In this exemplary embodiment, the lower jaw 34 which in general will not be contacted by the boat user or by an adjacent structure, the ribs have been omitted, whereas the upper jaw has ribs defined thereon substantially to its end edge. It is to be understood, however, that the ribs are an optional feature and, furthermore, other protrusion distributions or shapes could be provided.

In the illustrated embodiment, the upper, outer peripheral surface 40 of the upper jaw 32 is substantially continuously curved albeit with a larger radius of curvature than the outer surface 36 of the main body 12. The outer peripheral surface 42 of the lower jaw 34, on the other hand, is concavely curved in the illustrated embodiment to provide less resistance to flexing movement. As is apparent from the forgoing, the cutout area and resultant first and second jaws can flex open to accommodate a wide variety of stern or other boat edge shapes.

In the illustrated embodiment, the cutout 30 disposed between the first and second jaw members is generally V-shaped to define first and second faces 56,58 to accommodating the associated transom 24, swim platform 26 or other marine structure. In the presently preferred embodiment, angle α defined between the faces of the cutout is about 50–75 degrees, more preferably about 63 degrees, to accommodate a variety of transom structures. Further, each of the jaw members comprises an elongated tooth portion 60, 62 on the inner peripheral side thereof adjacent its free edge to more effectively engage the associated marine structure. In the illustrated embodiment, the tooth portion 62 of the lower jaw is more prominent to define a hook edge 46 to effectively grip the marine structure from below to avoid rotation of the fender (disengagement) in a clockwise direction when secured to the marine structure. The gripping faces 48,50 of each of the toothed portions may further includes surface features (not shown) to enhance frictional engagement between this portion of the fender and the boat structure. The tooth portion 60 of the upper jaw also defines a hook edge 48, as illustrated in FIG. 3.

According to a further feature of the invention, an air chamber or bladder 52 is defined in the interior of the fender main body 12 to provide added cushioning. More specifically, an airtight bladder 52 is advantageously incorporated in the fender main body, which may be accessed through an inflation valve 54, which in the illustrated embodiment is provided in the planar end face 14 at one end of the fender structure. Thus, the air pressure of the air chamber or bladder 52 may be regulated via the inflation valve to provide added cushioning as deemed necessary or desirable. The air bladder structure may be integrally molded in the fender main body as noted above, which may be in turn may be molded from flexible PVC.

Figure 5:
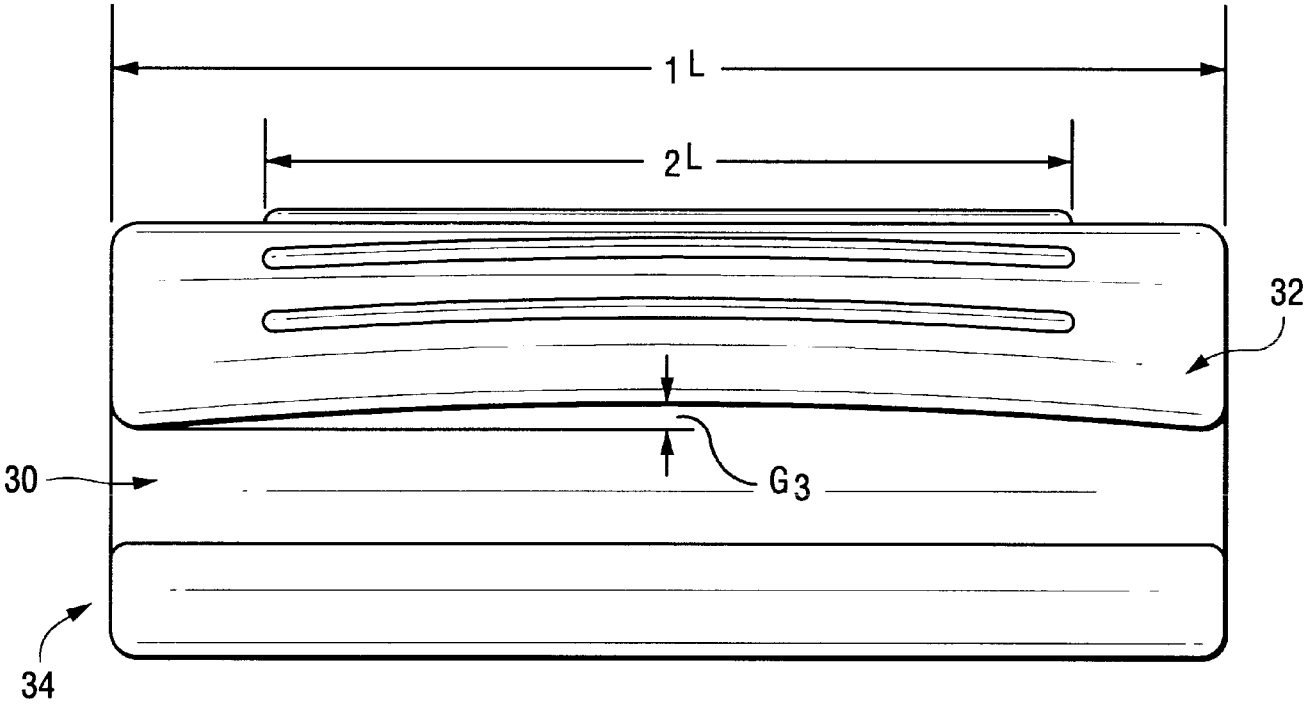
FIG. 5 is an elevational view taken from the right of FIG. 3.
Figure 6:
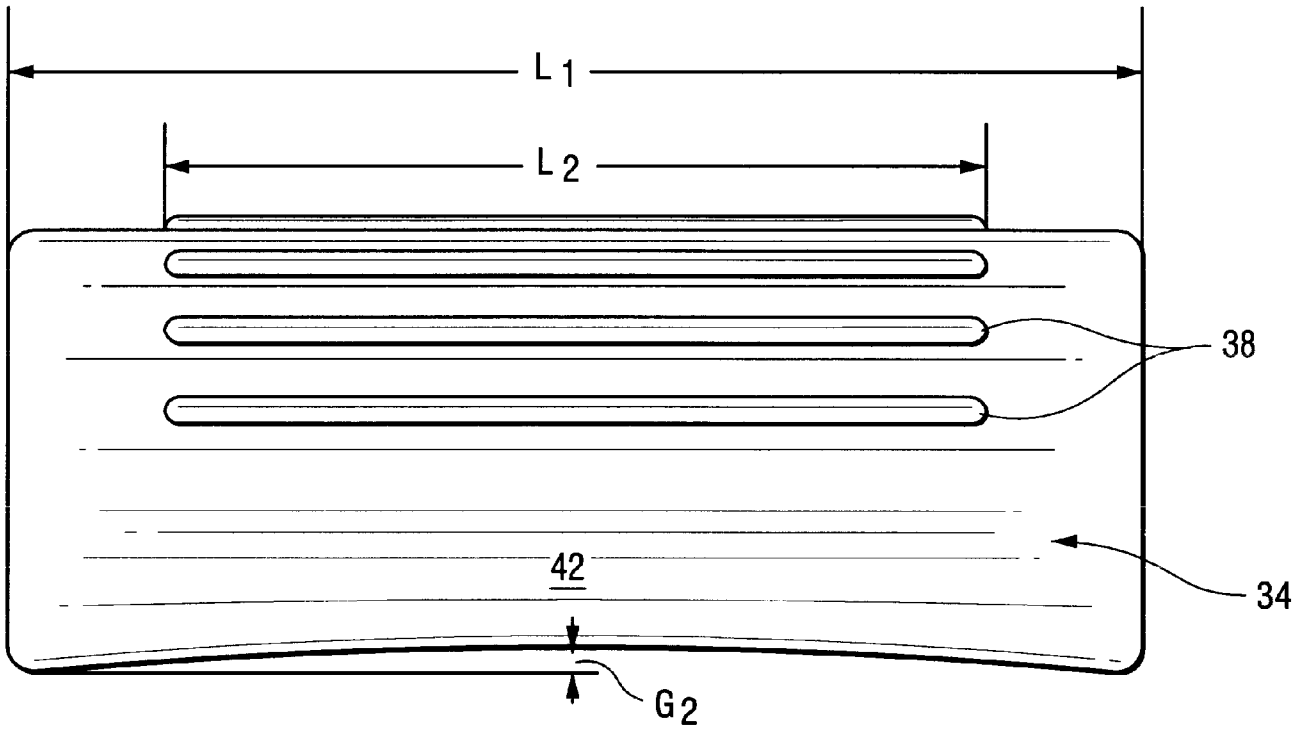
FIG. 6 is an elevational view taken in direction VI shown in FIG. 3.
Figure 7:
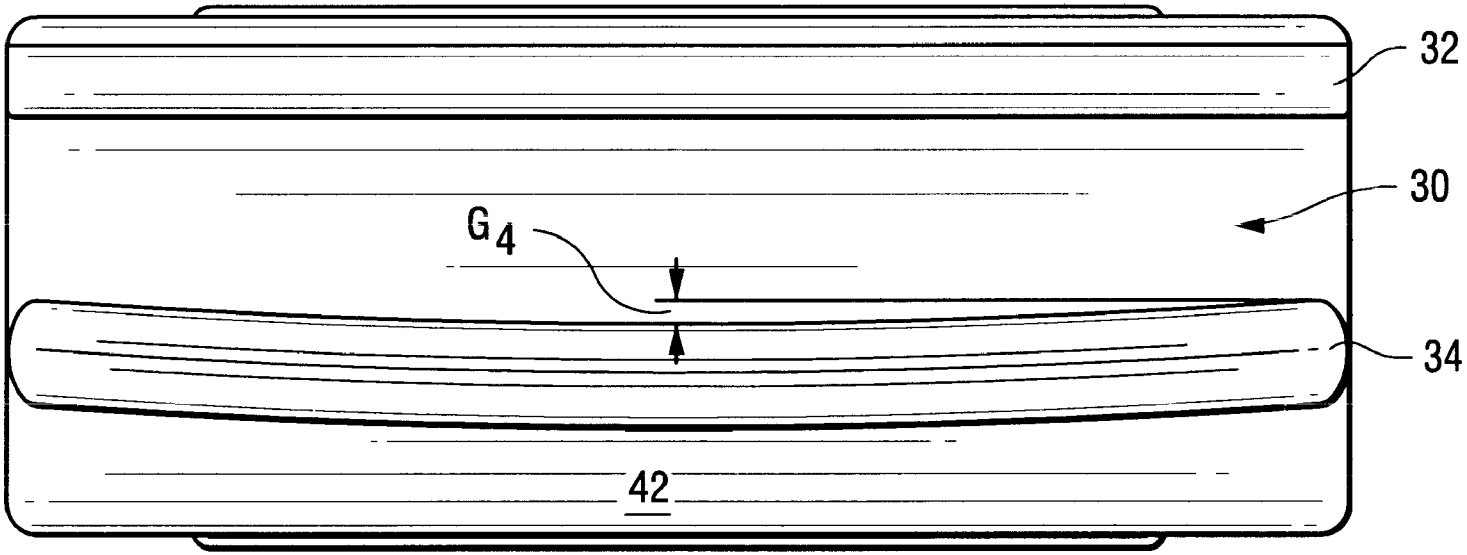
FIG. 7 is a view taken in direction VII shown in FIG. 3.

As illustrated in FIGS. 5–7, the fender is advantageously constructed with a curved shape, as shown by dimensions G2, G3, and G4, that allows it to conform to the typical curvature of the stern on many sailboats. More specifically, the free longitudinal edge of at least one of the first jaw and the second jaw is curved so as to bow in a direction generally transverse to the longitudinal axis of the fender so as to facilitate mounting to an associated curved edge. The curvature adopted may of course be varied, or omitted entirely, to accommodate a particular watercraft and/or mounting location.

As will be appreciated from a review of the foregoing disclosure, the fender of the invention may be provided in a variety of lengths depending upon the vessel and vessel part to which it is to be attached. In an exemplary embodiment, the fender has a length $L_1$ of about 22 inches. For such an embodiment, solely by way of example of a preferred configuration of the fender, the fender may be dimensioned (in inches) as detailed in below TABLE I.

TABLE I

| | Dimension Number | | | | | | | | | | | | | | |
|---|---|---|---|---|---|---|---|---|---|---|---|---|---|---|---|
| | L1 | L2 | G1 | G2 | G3 | D1 | D2 | D3 | D4 | H1 | H2 | H3 | H4 | T1 | T2 |
| Dimension in inches | 22 | 20 | 1.23 | .83 | .60 | 12.21 | 7.57 | 7.41 | 5.53 | 10.60 | 5.42 | 4.89 | 2.71 | 4.48 | 3.60 |

The fender of the present invention may be made from any suitable material which allows the fender to flex to accommodate the shape of the marine vessel with which it is engaged and to deform in response to and absorb the energy of impact with adjacent structures. Most preferably, the fender is molded from flexible PVC. A rigid PVC tube may be defined along the length of the fender to accommodate the securing rope or a bore may be integrally defined or thereafter formed in the fender structure. Because the fender is elongate, the fender of the present invention is able to absorb and dissipate some of the impact energy transversely from the point of impact along the length of the fender.

The fender may have a protective covering or coating and the covering or coating may be aesthetically colored or designed, abrasion resistant and/or waterproof.

Although the fender of the invention has been described in particular with reference to watercraft, it is to be understand that the fender of the invention may be attached to any structure used in any location requiring an elastomeric fender to provide absorption of energy and/or protection from damaging rubbing, including industrial and transport environments, car parks, amusement parts and the like as well as in marine environments, particularly marinas.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fender comprising:

an elongate resilient main body having first and second longitudinal ends;

first and second elongate jaw members integrally formed with said main body and coextensive therewith, said jaw members projecting from said main body to define a cutout therebetween, wherein a bore is defined longitudinally of at least one of said main body and said first jaw member for receiving a securing line for securing said fender to an associated structure, said bore having first and second open longitudinal ends and being closed along the length thereof, wherein said cutout is generally V-shaped, and further comprising a tooth portion along an inner surface of at least one of said jaw members.

2. A fender as in claim 1, wherein said main body has a part cylindrical outer peripheral surface contiguous with an outer peripheral surface of each said jaw member.

3. A fender as in claim 2, further comprising a plurality of longitudinally extending ribs defined on said outer peripheral surface of said main body.

4. A fender as in claim 2, wherein said outer peripheral surface of said first jaw member comprises a plurality of longitudinally extending rib structures to define a reduced slip surface.

5. A fender as in claim 1, wherein said bore is defined through and along the length of said first jaw.

6. A fender as in claim wherein an angle of said V-shaped cutout is between about 50 and 75 degrees.

7. A fender as in claim 1, wherein each said longitudinal end of said main body is generally planar.

8. A fender as in claim 1, further comprising an air chamber defined within said main body.

9. A fender as in claim 8, wherein said air chamber is sealed and further comprising an injection valve for injecting or removing air from said air chamber.

10. A fender comprising:

an elongate resilient body having first and second longitudinal ends and a longitudinal axis, a cutout being defined in said body along an entire length thereof so as to define first and second jaw members joined by a main body, wherein a bore is defined longitudinally of at least one of said main body and said first jaw member for receiving a securing line for securing said fender to an associated structure, said bore having first and second open longitudinal ends and being closed along the length thereof, wherein said cutout is generally V-shaped, and further comprising a tooth portion along an inner surface of at least one of said jaw members.

11. A fender as in claim 10, wherein said main body has a part cylindrical outer peripheral surface contiguous with an outer peripheral surface of said each said jaw member.

12. A fender as in claim 11, further comprising a plurality of longitudinally extending ribs defined on said outer peripheral surface of at least one of said main body and said outer peripheral surface of said first jaw member comprises a plurality of longitudinally extending rib structures to define a reduced slip surface.

13. A fender as in claim 10, wherein a free longitudinal edge of at least one of said first jaw member and said second jaw member is curved so as to bow in a direction generally transverse to said longitudinal axis so as to facilitate mounting to a curved structure.

14. A fender as in claim 10, wherein said cutout describes an angle of between about 50 and 75 degrees.

15. A fender as in claim 10, further comprising a sealed air chamber defined within said main body.

* * * * *